US009728917B2

(12) United States Patent
Pocrass

(10) Patent No.: US 9,728,917 B2
(45) Date of Patent: Aug. 8, 2017

(54) HIGH PROFILE USB CONNECTOR

(71) Applicant: Alan L. Pocrass, Simi Valley, CA (US)

(72) Inventor: Alan L. Pocrass, Simi Valley, CA (US)

( * ) Notice: Subject to any disclaimer, the term of this patent is extended or adjusted under 35 U.S.C. 154(b) by 175 days.

(21) Appl. No.: 14/264,192

(22) Filed: Apr. 29, 2014

(65) Prior Publication Data

US 2014/0335728 A1 Nov. 13, 2014

Related U.S. Application Data

(60) Provisional application No. 61/855,086, filed on May 7, 2013.

(51) Int. Cl.
*H01R 13/60* (2006.01)
*H01R 24/62* (2011.01)
*H01R 13/6594* (2011.01)

(52) U.S. Cl.
CPC ..... *H01R 24/62* (2013.01); *H01R 13/6594* (2013.01)

(58) Field of Classification Search
CPC ..... H01R 24/62
USPC ..... 439/607.35
See application file for complete search history.

(56) References Cited

U.S. PATENT DOCUMENTS 5,072,071 A * 12/1991 Cassity ..... H02B 1/056 174/135
5,800,192 A 9/1998 David et al.
5,854,904 A * 12/1998 Brown ..... G06F 1/1632 706/45
7,762,840 B2 * 7/2010 Hamner ..... H01R 13/65802 439/541.5
7,874,868 B2 * 1/2011 Chang ..... H01R 12/712 439/540.1
7,963,799 B1 * 6/2011 Lee ..... H01R 12/724 439/541.5
7,967,631 B2 * 6/2011 Wang ..... H01R 13/502 439/541.5
8,182,283 B2 * 5/2012 Chang ..... H01R 12/724 439/541.5
8,460,036 B1 * 6/2013 Chen ..... H01R 13/6474 439/660
8,535,098 B2 * 9/2013 Chen ..... H01R 13/659 439/607.35
8,721,364 B2 * 5/2014 Lai ..... H01R 27/02 439/540.1
8,734,182 B2 * 5/2014 Peng ..... H05K 5/0278 439/607.01
8,801,467 B2 * 8/2014 Lan ..... H01R 12/724 439/607.36

(Continued)

FOREIGN PATENT DOCUMENTS

EP 1089396 A2 4/2001

*Primary Examiner* — Abdullah Riyami
*Assistant Examiner* — Nelson R Burgos-Guntin
(74) *Attorney, Agent, or Firm* — The Webb Law Firm

(57) ABSTRACT

A high profile female USB connector for mounting to a substrate includes a heightened housing that elevates the female USB connector above and away from a surface of a substrate, such as a printed circuit board (PCB). The female USB connector, which can be a standard, mini, or micro USB type, is contained within the housing with contact pins extending from contacts of the female USB connector through a wall of the housing for connection to the substrate.

10 Claims, 5 Drawing Sheets

(56) References Cited

U.S. PATENT DOCUMENTS

| | | | | |
|---|---|---|---|---|
| 8,821,186 | B2 * | 9/2014 | Lan | H01R 13/514 439/540.1 |
| 8,858,260 | B2 * | 10/2014 | Saito | H01R 13/648 439/607.27 |
| 8,926,367 | B2 * | 1/2015 | Hsu | H01R 13/658 439/607.35 |
| 8,944,848 | B1 * | 2/2015 | Yu | H01R 24/64 439/607.01 |
| 8,974,252 | B1 * | 3/2015 | Yang | H01R 24/60 439/676 |
| 9,048,673 | B2 * | 6/2015 | Chang | H02J 7/0042 |
| 2002/0018049 | A1 * | 2/2002 | Love | G06F 1/1616 345/161 |
| 2013/0210274 | A1 * | 8/2013 | Lan | H01R 13/405 439/607.35 |
| 2013/0252466 | A1 * | 9/2013 | Chen | H01R 13/6658 439/607.35 |
| 2014/0335728 | A1 * | 11/2014 | Pocrass | H01R 24/62 439/607.35 |

* cited by examiner

TYPE A

TYPE B

MINI-A

MINI-B

MICRO-A

MICRO-B

HIGH PROFILE USB CONNECTOR

CROSS REFERENCE TO RELATED APPLICATION

This application claims the benefit of U.S. provisional patent application No. 61/855,086, filed May 7, 2013, entitled "High Profile USB Connector to Attach to Printed Circuit Board", which is incorporated herein by reference.

BACKGROUND OF THE INVENTION

Field of the Invention

The present invention relates to a high profile female USB connector for mounting to a substrate, such as, without limitation, a printed circuit board (PCB). The high profile USB connector enables components to be placed in front of the female USB connector on the PCB while providing plug and unplug access to the cavity opening of female USB connector by a male USB connector over the components in front of the female USB connector.

Description of Related Art

USB connectors are electrical connectors that are used for networking and computer products such as desk-top computers, laptops, tablets, cellphones, and other products which require connections to peripheral devices. USB connectors are used in many industries.

Universal Serial Bus (USB) is an industry standard developed in the mid-1990s that defines the cables, connectors and communications protocols used in a bus for connection, communication and power supply between computers and electronic devices.

USB was designed to standardize the connection of computer peripherals including keyboards, pointing devices, digital cameras, printers, portable media players, disk drives and network adapters to personal computers both to communicate and to supply electric power. It has become commonplace on other devices, such as smartphones, PDAs and video game consoles. USB has effectively replaced a variety of earlier interfaces, such as serial and parallel ports, as well as separate power chargers for portable devices.

The USB standard evolved through several versions before its official release in 1996: The first version USB 1 (Full Speed) is one type of USB connector. Released in January 1996, USB 1 specified data rates of 1.5 Mb/s (Low-Bandwidth) and 12 Mb/s (Full-Bandwidth). It did not allow for extension cables or pass-through monitors (due to timing and power limitations). Few USB devices made it to market until USB 1.1, released in August 1998, which fixed problems identified in USB 1.0, mostly relating to hubs. USB 1.1 was the earliest revision that was widely adopted.

The second version was USB 2.0 (High Speed) USB 2.0. Released in April 2000, USB 2.0 added higher maximum signaling rate of 480 Mbit/s (effective throughput up to 35 MB/s or 280 Mbit/s) (now called "Hi-Speed"). Further modifications to the USB specification have been done via Engineering Change Notices (ECN). The most important of these ECNs were included into the USB 2.0 specification package available from USB.org.

The third version, USB 3.0, was released in November 2008. The USB 3.0 standard defines a new "SuperSpeed" mode with a raw signaling speed of 5 Gbit/s and a usable data rate of up to 4 Gbit/s. USB 3.0 reduces the time required for data transmission, therefore reducing power consumption, and it is backward compatible with USB 2.0. The USB 3.0 Promoter Group announced on 17 Nov. 2008 that the specification of version 3.0 had been completed and had made the transition to the USB Implementers Forum (USB-IF), the managing body of USB specifications. This move effectively opened the specification to hardware developers for implementation in products. The new "SuperSpeed" bus provides a fourth transfer mode at 5.0 Gbit/s (raw data rate), in addition to the modes supported by earlier versions. As with previous USB versions, USB 3.0 ports come in low-power and high-power variants, providing 150 mA and 900 mA respectively while simultaneously transmitting data at SuperSpeed rates. Additionally, there is a Battery Charging Specification (Version 1.2—December 2010), which increases the power handling capability to 1.5 A but does not allow concurrent data transmission. The Battery Charging Specification requires that the physical ports themselves be capable of handling 5 A of current but the specification limits the maximum current drawn to 1.5 A.

A January 2013 press release from the USB group reveals plans to update USB 3 to 10 Gbit/s to put it on par with other type of emerging connectors like the Thunderbolt® connector. Thunderbolt® is a U.S. registered trademark of Apple, Inc. of Cupertino, Calif., Reg. No. 1078726.

There are several types of USB connectors, including some recently added ones. The original USB specification including Standard-A and Standard-B plugs and receptacles; the -B connector enabled cabling to be plugged at both ends while preventing users from connecting one computer receptacle to another. FIGS. 6A-6F show different types of USB-A and -B connectors including standard, mini, and micro types.

The USB type-A plug (FIG. 6A) is a flattened rectangle that inserts into a "downstream-port" receptacle on the USB host, or a hub, and carries both power and data. The USB type-A plug is frequently seen on cables that are permanently attached to a device, such as one connecting a keyboard or mouse to the computer via USB connection.

A USB type-B receptacle (FIG. 6B) has a square shape with beveled exterior corners and is configured to mate with an "upstream receptacle" on a device that uses a removable cable, e.g. a printer. On some devices, the USB type-B receptacle has no data connections, being used solely for accepting power from the upstream device.

The Mini-A plugs (FIG. 6C) and Mini-B receptacles (FIG. 6D) are approximately 3 by 7 mm. These mini-USB plugs and receptacles have a similar width and approximately half the thickness of USB type-A plugs and receptacles, enabling their integration into thinner portable devices.

USB micro-A (FIG. 6E) and micro-B (FIG. 6F) connectors were announced by the USB-IF on 4 Jan. 2007. The Mini-A plug and the Mini-B receptacle were deprecated on 23 May 2007. While many currently available devices and cables still use Mini connectors, the newer Micro connectors are being widely adopted and as of December 2010. The thinner USB micro-A and -B connectors are intended to replace the Mini USB connectors in new devices including smartphones, personal digital assistants, and cameras.

USB connectors are inexpensive, relatively simple to assemble, and easy to plug and unplug. A USB connector typically has a plastic body, with no locking mechanism to lock the male and female into place when connected.

USB female connectors (or receptacles) have socket houses for insertion of male USB plugs to form a connection. The housings are available in many configurations including a one port, multiple ports in a horizontal row, vertical, and stackable connectors which are stacked rows of USB connectors.

Prior art female USB connectors are designed to be mounted adjacent an edge of a PCB to facilitate plugging and unplugging of a mating male USB connector into a cavity opening of the prior art female USB connector, which cavity opening is positioned adjacent the surface of the PCB.

SUMMARY OF THE INVENTION

Disclosed herein is a high profile female USB connector having a female USB cavity opening that is positioned in elevated spaced relation to a surface of a substrate, e.g., a PCB, to which the high profile female USB connector is mounted. To this end, the female USB cavity opening is positioned (or elevated) higher away from the surface of the substrate than would be the case of the female USB cavity opening of a prior art female USB connector. The higher elevation of the female USB cavity opening of the high profile female USB connector disclosed herein enables it to mounted away from an edge of the substrate while still enabling plugging and unplugging of a mating male USB connector into the female USB cavity opening. The higher elevation of the female USB cavity opening of the high profile female USB connector disclosed herein also facilitates mounting of one or more components to the substrate (e.g., without limitation, a switch, an IC, a transistor, a capacitor, an inductor, and the like) below and in-front of the female USB cavity opening while also enabling plugging and unplugging of a mating male USB connector into the female USB cavity opening above said component(s).

The high profile female USB connector can have a snap fit connector and/or tabs for mounting the connector away from the edge of a substrate while providing support for the connector during plugging and unplugging of a mating male USB connector into the female USB cavity opening.

The positioning of the female USB connector cavity opening at a higher position can avoid electromagnetic emissions emanating from the female USB connector from interfering with other components mounted on the substrate.

The high profile female USB connector can include shielding on one or more of the connector housing, e.g., on the front, top, sides, bottom and rear faces. The front face of the high profile female USB connector can include the female USB cavity opening, i.e., a jack cavity.

More specifically, disclosed herein is a high profile female USB electrical connector that comprises: a plurality of walls defining a housing; a female USB connector inside the housing, the housing including an opening having a height H and a width W configured to facilitate insertion of a male USB connector into the female USB connector; contact pins extending from contacts of the female USB connector through at least one of the plurality of walls of the housing for connection to a substrate; and electromagnetic interference (EMI) shielding on one or more of the plurality of walls. A distance between an exterior bottom wall of the plurality of walls of the housing and one of the contacts that is the closest (distance-wise) to the exterior bottom wall is at least 1.5×H. Between the female USB connector and the exterior bottom wall, the inside of the housing does not include another connector. In other words, the housing does not include another connector between the female USB connector and the base of the housing.

The distance between the exterior bottom wall of the housing and one of the contacts that is the closest to the exterior of the bottom wall can be at least 2×H.

The substrate can be a PCB.

The shielding can cover bottom, top, side, and rear walls of the housing.

The female USB connector can be positioned horizontally in the housing.

The high profile female USB electrical connector can further include a snap fit connector extending from the housing. The snap fit connector can include at least a partial rim and an end that is adapted to compress upon initial insertion into an opening in the substrate and expand upon passage of the rim through the opening.

The high profile female USB electrical connector can further include a shield tab coupled to the shield and extending from the housing. The snap fit connector can extend from the housing in a same direction as the shield tab, e.g., from the exterior bottom wall of the housing.

A front wall of the housing can includes between the opening and a bottom wall of the housing a section that is recessed toward a back wall of the housing.

Further details and advantages of the present invention will become apparent upon reading the following detailed description in conjunction with the accompanying drawings.

DETAILED DESCRIPTION OF THE INVENTION

Figure 1:
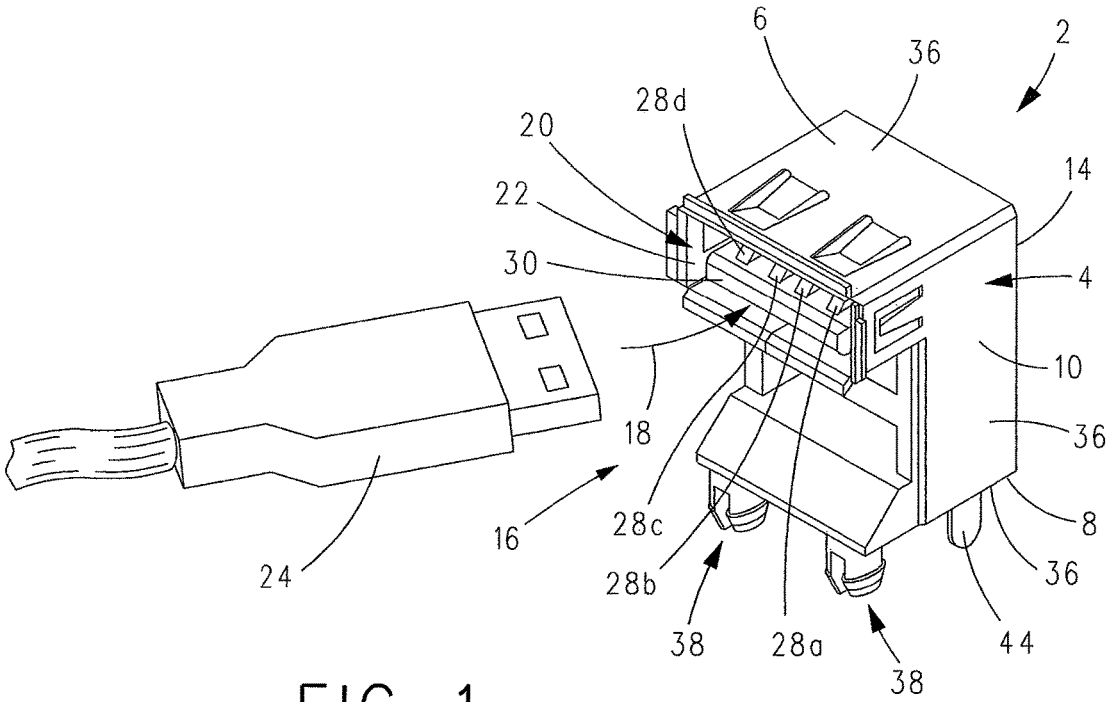
FIG. 1 is a perspective view of an embodiment high profile female (type-A) USB connector.
Figure 2:
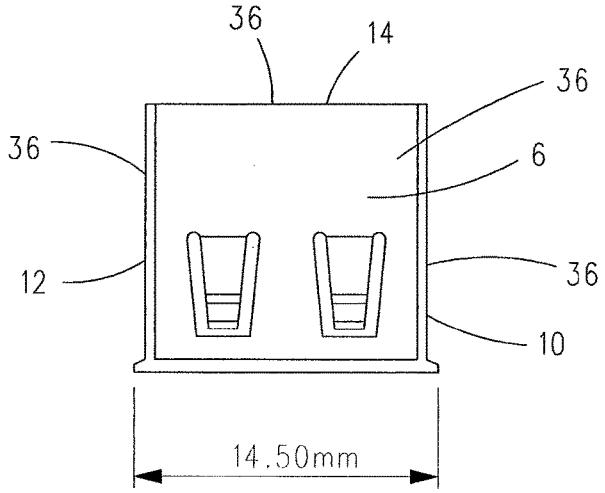
FIG. 2 is top view of the high profile female USB connector of FIG. 1.

The present invention will be described with reference to the accompanying figures where like reference numbers correspond to like elements. The dimensions shown in the figures are in millimeters (mm) and are representative of an embodiment of the high profile female USB connector described herein. However, these dimensions are not to be construed in a limiting sense since the use of one or more different dimensions is envisioned.

With reference to FIGS. 1-5, a high profile USB connector 2 includes a housing 4 having a top wall 6, a bottom wall 8, a left side wall 10, a right side wall 12, a back wall 14, and a front wall 16.

Connector 2 includes a female USB connector 20 inside of housing 4. Front wall 16 of housing 4 includes an opening 22 having a height H and a width W configured to facilitate insertion of a mating male USB connector 24 into female USB connector 20 when male USB connector 24 is moved in the direction of arrow 18 into female USB connector 20.

Female USB connector 20 includes contacts 28*a*-28*d* disposed on a top surface of a USB printed circuit board (PCB) 30 which is positioned inside the cavity opening 22 of female USB connector 20. Female USB connector 20 also includes contact pins 26*a*-26*d* which extend from contacts

28*a*-28*d*, respectively through female USB connector 20 through at least one of the walls of housing 2, e.g., bottom wall 8, for connection to a substrate, such as, for example, a mounting PCB 32.

Housing 4 includes electromagnetic interference (EMI) shielding 36 on one or more of the walls of housing 4, e.g., without limitation, walls 6, 10, 12, 14, and, optionally, wall 8. FIGS. 2, 3B, 4B, and 5 include exemplary dimensions of connector 2. These dimensions, however, are not to be construed as limiting the invention.

Extending from bottom wall 8 of housing 4 is one or more snap fit connections 38. Each snap fit connection 38 includes at least a partial rim 40 and a distal end 42 that is adapted to compress laterally upon initial insertion into an opening 34 of mounting PCB 32 and expand laterally upon passage of partial rim 40 through said opening 34. The construction and operation of snap fit connection 38 is known in the art.

Shielding 36 includes one or more shield tabs 44 coupled to shielding 36 and extending from housing 2, e.g., away from bottom wall 8, for receipt and affixing in mating receptacles (not shown) of mounting PCB 32 by any means known in the art, e.g., press fit, soldering, etc.

Desirably, female USB connector 20 is positioned horizontally in housing 2. However, it is envisioned that female USB connector 20 can be positioned vertically in housing 2.

Figure 3A:
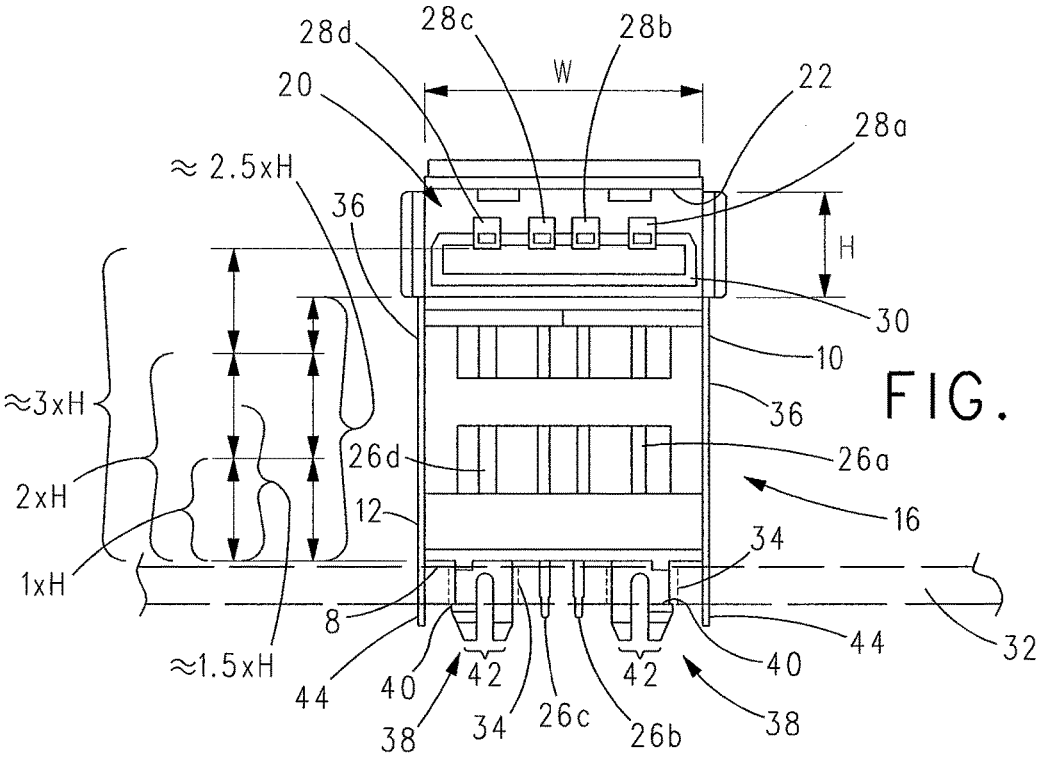
FIG. 3A is a front view of the high profile female USB connector of FIG. 1.
Figure 3B:
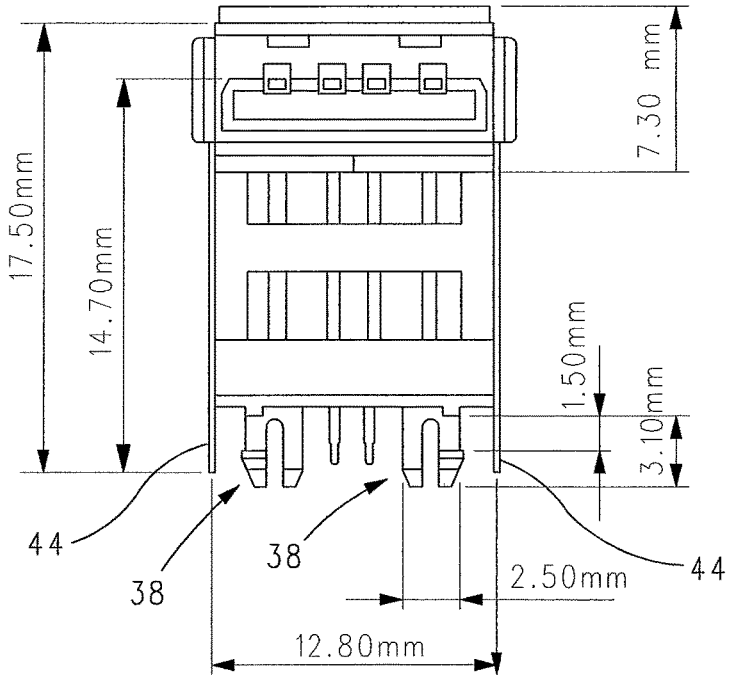
FIG. 3B is another front view of the high profile female USB connector of FIG. 1 including exemplary, non-limiting dimensions.

Desirably, a distance between an exterior of bottom wall 8 of housing 2 and a bottom surface of one of the contacts 28 that is closest to said exterior bottom wall 8 is at least 1.5×H, where H is the height of opening 22. More desirably, the distance between exterior bottom wall 8 and the bottom surface of one of the contacts 28 is at least 2×H and, more preferably, 3×H—all as shown in FIG. 3*a*.

Figure 4A:
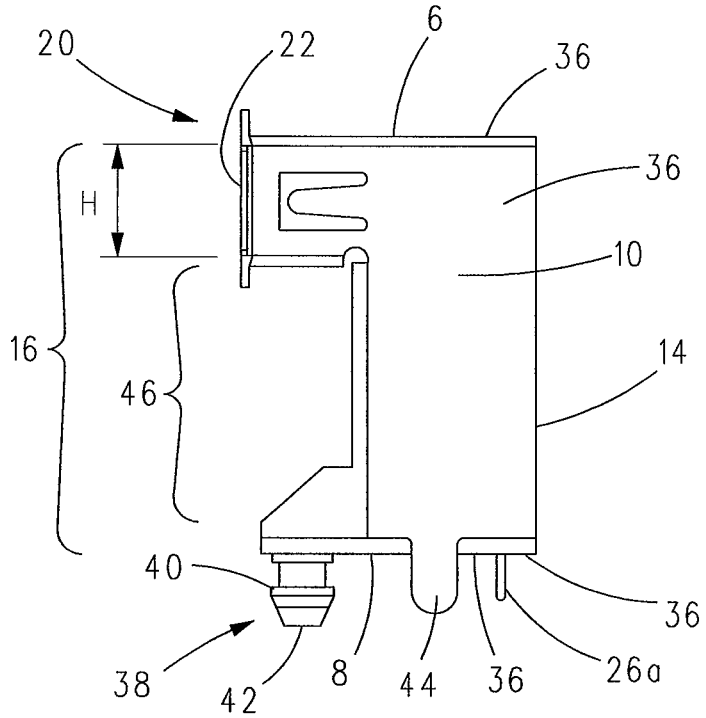
FIG. 4A is a left side view of the high profile female USB connector of FIG. 1.
Figure 4B:
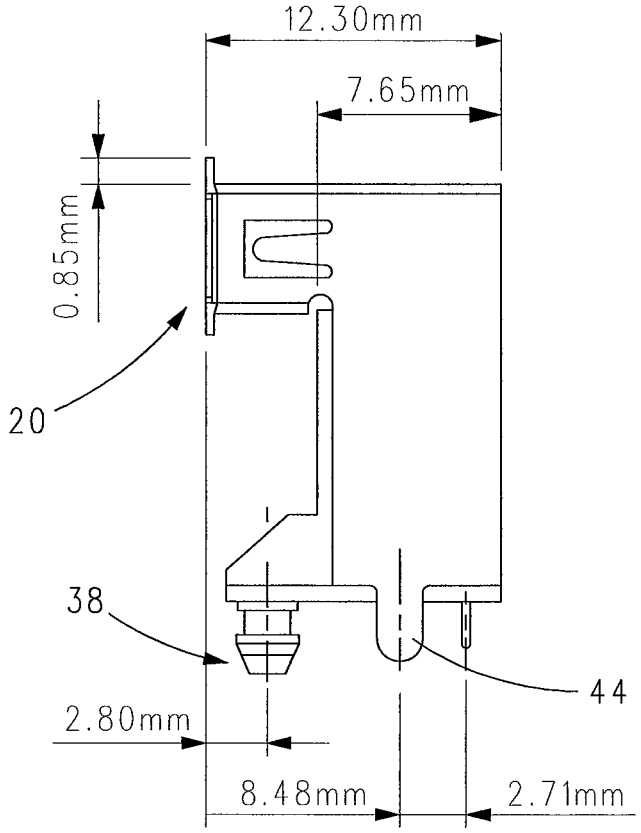
FIG. 4B is another left side view of the high profile female USB connector of FIG. 1 including exemplary, non-limiting dimensions.
Figure 5:
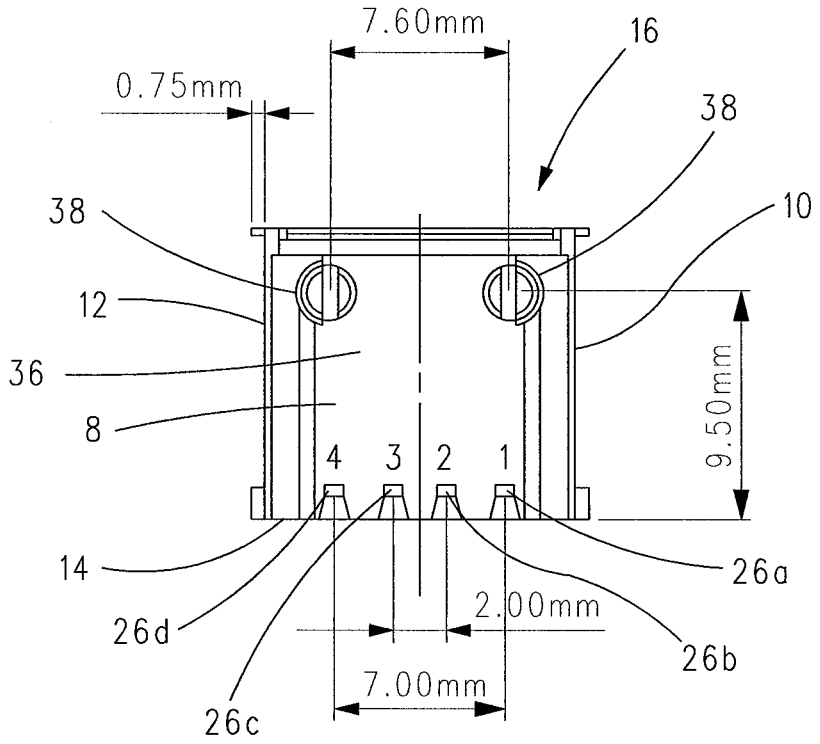
FIG. 5 is a bottom view of the high profile female USB connector of FIG. 1 including exemplary, non-limiting dimensions.
Figure 6A:
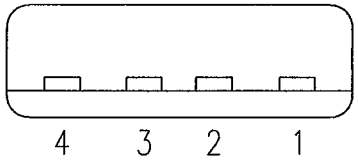
FIG. 6A (PRIOR ART)
FIGS. 6A-6F are schematic views of prior art USB connectors including respective Standard Type-A and Type-B, Mini-A and Mini-B, and Micro-A and Micro-B.
Figure 6B:
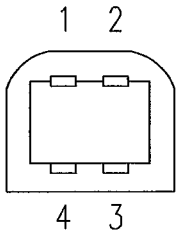
FIG. 6B (PRIOR ART)
Figure 6C:
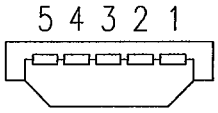
FIG. 6C (PRIOR ART)
Figure 6D:
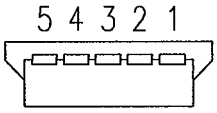
FIG. 6D (PRIOR ART)
Figure 6E:
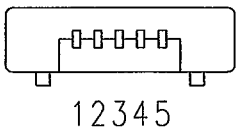
FIG. 6E (PRIOR ART)
Figure 6F:
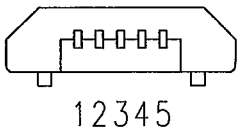
FIG. 6F (PRIOR ART)

As shown best in FIG. 4*a*, front wall 16 of housing 2 includes, between cavity opening 22 and bottom wall 8, an optional section 46 that is recessed toward back wall 14 of housing 2, whereupon female USB connector 20 is cantilevered over a space in front of recessed section 46 of front wall 16. The construction of housing 4 with front wall 16 having recessed section 46 and with female USB connector 20 cantilevered over the space in front of recessed section 46 of front wall 16, however, is not to be construed as limiting the invention since it is envisioned that recessed section 46 can be omitted whereupon housing 4 has more of a box-like shape.

As can be seen, between female USB connector 20 and the exterior of bottom wall 8 of housing 4, housing 4 does not house another connector. In other words, no other connector of any type resides between female USB connector 20 and bottom wall 8 of housing 4.

As can be seen, the present invention is a high profile female USB connector having a female USB cavity opening that is positioned in elevated spaced relation to a surface of a substrate (e.g., mounting PCB 32) to which the high profile female USB connector is mounted. This higher elevation enables the connector to be mounted away from an edge of the substrate while still enabling plugging and unplugging of a mating male USB connector into the female USB cavity opening. The higher elevation also facilitates mounting of one or more components to the substrate below and in front of the female USB cavity opening while also enabling plugging and unplugging of the mating male USB connector into the female USB cavity opening above said components.

The invention has been described with reference to an exemplary embodiment. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A high profile female USB electrical connector comprising:

a plurality of walls defining a housing;

a female USB connector inside the housing, the housing including an opening having a height H and a width W configured to facilitate insertion of a male USB connector into the female USB connector;

contact pins extending from contacts of the female USB connector through a bottom wall of the housing proximate a back wall of the housing for connection to a substrate;

one or more connections extending from the bottom wall of the housing proximate a front wall of the housing for connection to the substrate; and electromagnetic interference (EMI) shielding on one or more of the plurality of walls, wherein:

the contact pins and the one or more connections are spaced from each other between the front wall and the back wall of the housing;

a distance between an exterior of the bottom wall of the housing and one of the contacts that is the closest to the exterior of the bottom wall is at least 1.5×H; and between the female USB connector and the exterior of the bottom wall, the inside of the housing does not include another connector.

2. The high profile female USB electrical connector of claim 1, wherein the distance between the exterior of the bottom wall of the housing and one of the contacts that is the closest to the exterior of the bottom wall is at least 2×H.

3. The high profile female USB electrical connector of claim 1, wherein the substrate is a PCB.

4. The high profile female USB electrical connector of claim 1, wherein the shielding covers top, side, and back walls of the housing.

5. The high profile female USB electrical connector of claim 1, wherein the female USB connector is positioned horizontally in the housing.

6. The high profile female USB electrical connector of claim 1, wherein each connection is a snap fit connector.

7. The high profile female USB electrical connector of claim 1, wherein the snap fit connector includes at least a partial rim and an end that is adapted to compress upon initial insertion into an opening in the substrate and expand upon passage of the rim through the opening.

8. The high profile female USB electrical connector of claim 1, further including a shield tab coupled to the shield and extending from the housing.

9. The high profile female USB electrical connector of claim 8, wherein each connection is a snap fit connector extending from the exterior of the bottom wall of the housing in a same direction as the shield tab.

10. The high profile female USB electrical connector of claim 1, wherein the front wall of the housing includes between the opening and the bottom wall of the housing a section, between the female USB connector and the bottom wall, that is recessed toward the back wall of the housing.

* * * * *